United States Patent [19]

Nishi et al.

[11] 4,253,426

[45] Mar. 3, 1981

[54] RESERVOIR TYPE WATER HEATING DEVICE

[75] Inventors: Atsuyoshi Nishi; Hiroyasu Kuwazawa; Kaneyoshi Oshima, all of Nakatsugawa, Japan

[73] Assignee: Mitsubishi Denki Kabushiki Kaisha, Tokyo, Japan

[21] Appl. No.: 953,253

[22] Filed: Oct. 20, 1978

[30] Foreign Application Priority Data

Oct. 25, 1977 [JP] Japan ..... 52-143062

[51] Int. Cl.[3] ..... F22B 5/00

[52] U.S. Cl. ..... 122/13 R; 126/361; 122/17; 122/494; 237/19

[58] Field of Search ..... 122/13, 17, 156, 494; 126/361; 237/19

[56] References Cited

U.S. PATENT DOCUMENTS

| | | | |
|---|---|---|---|
| 1,904,511 | 4/1933 | Mutrux et al. | 122/13 R |
| 1,933,056 | 10/1933 | Hamilton | 122/17 |
| 1,944,817 | 1/1934 | Thomas | 122/13 R |
| 1,961,723 | 6/1934 | Wilson | 122/17 |
| 2,244,831 | 6/1941 | Drichta et al. | 126/101 |
| 2,650,575 | 9/1953 | Carlson | 122/494 |
| 2,852,462 | 9/1958 | Andrus | 122/13 R |
| 2,923,797 | 2/1960 | Thelen | 126/361 |
| 3,007,470 | 11/1961 | Helger | 237/19 |
| 3,320,932 | 5/1967 | Jacobson | 122/13 R |
| 3,401,920 | 9/1968 | Berkhoudt et al. | 432/223 |
| 3,490,420 | 1/1970 | Kramer | 122/17 |
| 3,659,560 | 5/1972 | Carter | 122/494 |
| 3,707,142 | 12/1972 | Kobayashi | 122/17 |

FOREIGN PATENT DOCUMENTS

| | | | |
|---|---|---|---|
| 2260759 | 9/1975 | France | 237/19 |
| 49-36175 | 9/1974 | Japan . | |
| 51-4296 | 2/1976 | Japan . | |

*Primary Examiner*—Henry C. Yuen

*Attorney, Agent, or Firm*—Wenderoth, Lind & Ponack

[57] ABSTRACT

A vertical drum is disposed upon and connected to a combustion chamber through a heat transfer wall. A burner opens in the combustion chamber to face the heat transfer wall and an exhaust tube is connected to the combustion chamber on the lower wall adjacent its periphery and extends horizontally below the drum until it communicates with the atmosphere.

16 Claims, 3 Drawing Figures

RESERVOIR TYPE WATER HEATING DEVICE

BACKGROUND OF THE INVENTION

This invention relates to a reservoir type water heating device serving as a source of hot water supply used with a central hot water supply system or a small-sized central hot water system and more particularly to such a device employing a combustion device as a heating source and especially including an exhaust pipe for exhaust gases generated by the combustion.

In central hot water supply systems or small-sized simple hot water supply systems (which supply hot water to the bath, kitchen, washing stand etc. which are used in a single house), the heating source therefor is made up of a reservoir type water heating device adapted to be heated by a combustion device. It has been found that in a water heating device of the type referred to and which includes the exhaust pipe through which exhaust gases resulting from the combustion effected by an associated combustion device are exhausted outside thereof, and particularly in which petroleum products such as, for example, kerosene is used as a fuel, it has been found that frequently, a gun type burner is used.

In conventional reservoir type water heating devices which include a gun type burner, the drum serving as a hot water reservoir has a combustion chamber underneath a heat transfer wall and the burner establish a flame within the combustion chamber to heat water in the drum. A flue is made of a heat transfer material and communicates with the combustion chamber and extends centrally through the drum to exhaust gaseous combustion products to the atmosphere. After the flame is automatically cut-off in the combustion chamber due to the water in the drum reacting a predetermined temperature, heat accumulated in the water dissipates from the heat transfer wall and flue to the atmosphere through spontaneous convection. Accordingly, the greater the amount of hot water accumulated in the drum the greater a quantity of dissipated heat will result in the undesirable problem that the operation efficiency decreases. In view of applicants' experience, it is believed that this problem has not been noticed by experts in the field and therefore no measures to solve the problem have been taken.

SUMMARY OF THE INVENTION

Accordingly, it is a principal object of the present invention to prevent or suppress heat accumulated in an amount of hot water within a hot water reservoir and keep it from dissipating through a flue.

Another object of the present invention to provide a new and improved reservoir type water heating device which accomplishes the principal object as above described in the preceding paragraph.

It is another object of the present invention to improve the outer portion of a reservoir type water heating device for preventing or suppressing the heat dissipation as above described.

The present invention provides a reservoir type water heating device which includes, in combination, a closed end drum including a hot water reservoir formed therein for accumulating a specified amount of hot water, the drum communicates with both a water supply pipe and a hot water delivery pipe. There is a combustion means disposed outside of the hot water reservoir and below the reservoir which includes a combustion chamber to heat water within the reservoir through the drum, which includes a heated surface member which is convex toward the interior thereof, and form gaseous combustion products therein. An exhaust passageway is connected to the combustion chamber to exhaust the gaseous combustion products externally of the combustion chamber therethrough with the exhaust passageway being disposed outside of the hot water reservoir without extending through the latter.

In a preferred embodiment of the present invention, the exhaust passageway can be a tube having a transverse tube portion with one end portion located outside of a space disposed directly under the drum, and a longitudinal tube portion with one end connected to the other end of the transverse tube portion and the other end communicating with the combustion chamber.

In order to increase the overall efficiency, a chimney can be disposed vertically outside of the drum so that a lower end thereof is connected to the one end of the transverse tube portion with the chimney having an upper end connected to a transversely disposed extension which is tilted downward at a predetermined angle to the horizontal.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
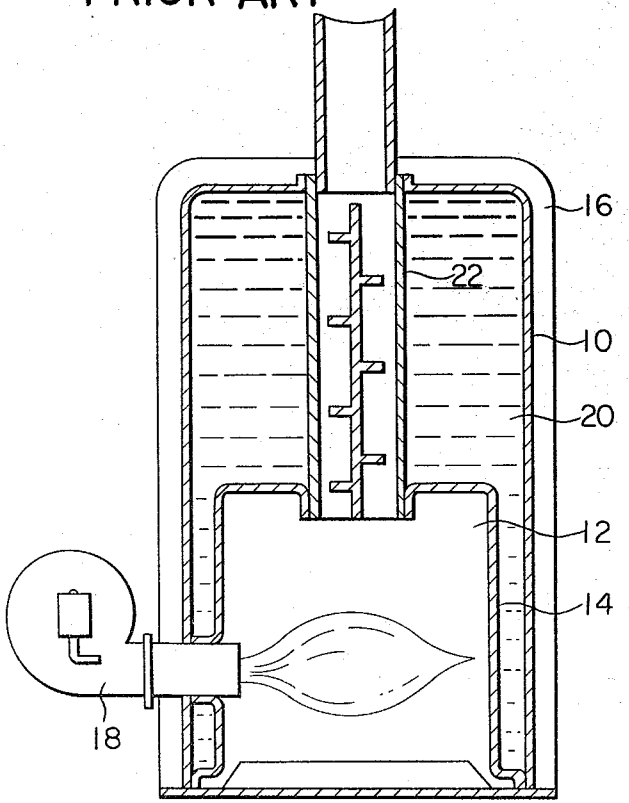
FIG. 1 PRIOR ART
FIG. 1 is a longitudinal sectional view of a conventional reservoir type water heating device with parts illustrated in elevation.

Referring now to FIG. 1 of the drawings, there is shown a conventional reservoir type water heating device. The arrangement illustrated includes a water drum 10, a combustion chamber 12 disposed on the lower portion of the drum and surrounded by a heat transfer wall 14 except that a bottom surface thereof is made up by the bottom wall of the drum. The drum 10 is covered with a heat isolating member 16 and a burner 18 is disposed outside of the lower portion of the heat isolating member 16 so as to open in the combustion chamber 12. The burner 18 is operative to establish a flame within the combustion chamber 12 to heat an amount of water 20 filling the drum 10.

A flue 22 communicates with the combustion chamber 12 and extends centrally through the drum 10. The flue 22 serves as an exhaust pipe through which gaseous combustion products formed in the combustion chamber 12 are exhausted to the atmosphere. The flue 22 also performs the function of transferring heat from the gaseous combustion products to the water 20 contained in the drum 10.

In operation, the water 20 is heated by the flame which is established within the combustion chamber 12 for accumulating heat therein. When the heated water 20 reaches a predetermined temperature, the flame is automatically extinguished. After extinguishing of the flame, heat accumulated in the hot water 20 is transmitted through the heat transfer wall 14 and the flue 22 wall and dissipated from inner surfaces thereof through spontaneous convection. Therefore, the greater the amount of hot water contained in the drum 10 the greater the amount of heat dissipated from the hot water which will result in the undesirable problem that the operation efficiency decreases. In view of experiences encountered by the applicants till now, it has been believed that this undesirable problem has not been previously noticed by experts in the field and therefore, no measures to solve it have yet been taken.

The quantity of dissipated heat as above described can be expressed by $$Q=\alpha S\Delta T \text{ and } \Delta T=t_w-t_a$$

where Q designates the quantity of dissipated heat in Kcal/hr, $\alpha$ the convection heat transfer rate in Kcal/m$^2$hr°C., S the convection heat transfer area in m$^2$, $t_w$ the temperature on the heat transfer surface in °C. and $t_a$ designates the ambient temperature in °C.

In water heating devices commonly marketed in Japan, the quantity of dissipated heat Q has a value of $8\times1.1\times70\approx600$ Kcal/hr, because $\alpha$, S and $\Delta T$ generally have values of 8 Kcal/m$^2$hr°C., 1.1 m$^2$ and $80-10=70°$ C. respectively.

Each home which is served by a simple central hot water-supply system usually has a hot water supply consumption on the order of 20,000 Kcal a day which figure averages to 1,500 Kcal/hr per twelve hours. Therefore it can be understood that the quantity of dissipated heat as above calculated is large when compared to the mean figure just specified.

Although conventional gun type burners are good for certain uses they suffer the disadvantages that they are actually not very good in combustive properties as well as producing soot due to their diffusion type combustion. Further, the flames caused by this diffusion combustion, are in direct contact with an adjacent cold heat transfer wall or the like and this is one of causes for sooting. This has led to the requirement of increasing the particular combustion chamber size by allowing for a sufficient space margin.

On the other hand, in order to increase the efficiency of heat exchange, it is required to increase a Reynolds number of a heat transfer portion. This results in the requirement of increasing the flow speeds of associated fluids or to decrease a hydraulic diameter involved. However, because of a fear that the heat transfer wall will become sooted, the efficiency of heat exchange cannot be greatly increased and usually ranges from about 60% to about 75%. Accordingly when the amount of heat dissipated is taken into consideration, the actual efficiency of operation is of about 50% to about 60% the remainder resulting in the waste of thermal energy.

Figure 2:
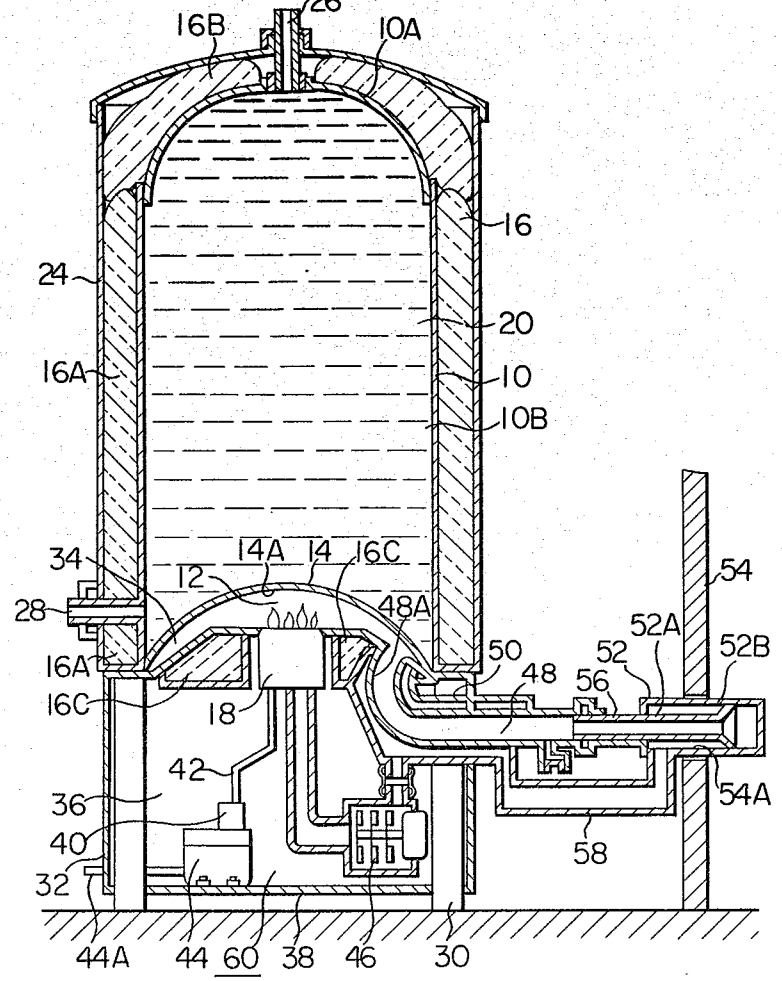
FIG. 2 is a longitudinal sectional view of one embodiment showing the reservoir type water warming device of the present invention with parts illustrated in elevation.

Referring now to FIG. 2, there is illustrated a reservoir type water heating device according to the present invention. The arrangement illustrated includes a vertically disposed metallic drum 10 shaped like a hollow cylinder including an upper end closed with an apertured dome-shaped wall 10A and a lower end closed with a combustion chamber 12 which is shaped like a generally crescent section to form a hot water reservoir 10B therein. The combustion chamber 12 includes an upper heat transfer wall 14 made of any suitable metallic material which is spherically convex toward the interior of the drum 10 with its periphery connected in watertight relationship with the bottom of the drum and a lower metallic wall shaped like a truncated cone including with the central aperture and a periphery rigidly connected to the bottom of the drum 10. A cylindrical burner 18 is coaxially disposed in the truncated cone and opens into the central aperture on the lower wall of the combustion chamber 12 so as to face a heated surface 14A located at the lower surface as viewed in FIG. 2 of the heat transfer wall 14.

The interior of the drum 10 or reservoir 10B is filled with an amount of water to be heated or hot water designated by the reference numeral 20 and the outside of the drum is surrounded by a conventional heat insulating material 16. As shown in FIG. 2, a portion of the heat insulating material 16A contacts and surrounds the outer peripheral wall of the drum 10, another portion of the heat insulating material 16B is disposed on the dome-shaped wall 10A of the drum 10 and still another portion of the heat insulating material 16C is suitably secured to the lower surface of the lower wall of the combustion chamber 12 located below the bottom of the drum.

The drum 10 is enclosed within a coaxial metal enclosure 24 and has a top cover which sandwiches the portions of the heat insulating material 16A and 16B therebetween. A hot water delivery pipe 26 extends through and is sealed with the top enclosure cover and is snugly fitted into an aperture on the dome-shaped drum wall 10A while a water supply pipe 28 extends through and is sealed with the enclosures 24 at its level which is substantially equal to that of the central portion of the combustion chamber 12 and then extends through the adjacent part of the lower portion of the heat insulating material 16A until it opens in the interior of the drum 10.

In this way, the drum 10, the enclosure 24 and the associated components are connected into a unitary structure and supported by a plurality of leg members 30 (only two of which are illustrated) which are standing up on the foundation. A hollow cylindrical casing 32 which is substantially equal in diameter to the enclosure 24 is suitably connected to the bottom of the enclosure 24 for defining upper space 34 which is occupied by the combustion chamber 12 and the substantial portion of the burner 18 and a lower space 36 which is overlaid with the space 34 along with the upper heat transfer wall 14 and a bottom plate 38 which closes the lower end thereof. The bottom plate 38 is located below the burner 18 so as to be spaced away from the latter by a predetermined distance.

The burner 18 is operative to burn a mixture of an atomized liquid fuel formed through vaporization and the primary air. The liquid fuel may comprise kerosene. To this end, an electromagnetic pump 40 which is of conventional construction is disposed in the lower space 36 so as to be spaced away from the burner 18 by a predetermined distance and connected to the latter through a fuel feed tube 42. A constant oil-level device 44 is disposed on the bottom plate 38 and overlaid with the pump 40. The constant oil-level device 44 is well known in the art and is adapted to be supplied with a fuel from an external oil reservoir (not shown) through a fuel supply pipe 44A which extends through the casing 32. In order to supply the primary air or burning air to the burner 18, a blower 46 is mounted on the bottom plate 38 and connected to the burner 18 through an air supply tube. The blower 46 is also spaced away from the burner 18 by a predetermined distance.

The burner 18 is operative to stop the burning when the water 20 reaches a predetermined temperature and to effect again the burning in response to the water decreasing to another predetermined temperature than the first described predetermined temperature. Components for controlling the operation of the burner are also disposed within the lower space 36 although such components are not illustrated.

As shown in FIG. 2, an exhaust passageway 48 shaped like a metallic tube includes a transverse tube portion horizontally disposed so as to extend perpendicularly through the casing 32 and has one end portion disposed outside of the space 36 just located below the drum 10. The exhaust tube 48 also includes a longitudinal tube portion 48A connected to the other end of the transverse tube portion and extends upward in the form of a bend so as to open in the conical portion of the lower wall of the combustion chamber 12 adjacent to the periphery thereof. The exhaust passageway 48 is encircled by an air feed passageway 50 shaped like a metallic tube to form an annular air passageway therebetween. The air feed tube 50 includes a closed end adjacent to that end of the exhaust tube 48 opening in the combustion chamber 12 and communicates with the blower 46 on the suction side. The air feed tube 50 also extends through the casing 32 while forming a double tube structure with the exhaust tube 48.

The exhaust and feed passageways 48 and 50 respectively are connected to a combined feed and exhaust duct 52 extending through an opening 54A disposed on a wall 54. More specifically, the exhaust passageway 48 is connected to an inner tube portion 52A of the duct 42 through an extension 56 thereof while the air feed passageway 50 is connected to an outer tube portion 52B encircling the inner tube portion 52 through a connection tube 58 disposed so as to be spaced away from the extension 56. The inner tube portion 52A serves to exhaust gaseous combustion products formed in the combustion chamber 12 to the atmosphere while the outer tube portion 52B serves to such the air to deliver it to the blower.

From the foregoing it is seen that a combustion device generally designated by the reference numeral 60 is made up by the combustion chamber 18, the electromagnetic pump 40, the constant oil-level device 44, the blower 46, the exhaust passageway 48, the air feed pssageway 50 etc. and supported by the leg members 30 and the bottom plate 38.

In operation the burner 18 heats the amount of water 20 in the reservoir 10B while gaseous combustion products are exhausted through the exhaust tube 48 and the associated components. When the water 20 reaches its predetermined temperature, the burning is stopped at and after which heat accumulated in the water is dissipated through the heat transfer wall 12. However, since the exhaust tube 48 is lower than the heat transfer wall 12, the convection causes no heat dissipation. In other words, thermal energy remains in the combustion chamber 12 without escaping therefrom. Also the heat transfer wall 14 is located at the bottom rather than the upper or peripheral wall of the drum 10 while the water creates a temperature boundary having a low temperature in the lower portion of the drum 10 due to its convection. As a result, the heat transfer wall is placed at a low temperature and accordingly a temperature difference between the heat transfer wall 14 and air within the combustion chamber 12 is small. This results in a decrease in the amount of dissipated heat. More particularly, when the heat dissipation through the heat transfer wall 14 occurs, the amount of dissipated heat therethrough is decreased. This results in an increase in overall efficiency.

The hot water 20 is delivered through the hot water delivery pipe 26 and cold water automatically replenishes the drum's interior or hot water reservoir 10A, through the water supply pipe 28 until the water 20 is lowered to its predetermined temperature. At that time, the combustion device 60 is initiated automatically to effect the burning to heat the water 20 as in the prior art practice, until the water reaches the predetermined temperature which is higher than that just described.

The process as above described is repeated to always accumulate the hot water 20 in the reservoir 10A.

Figure 3:
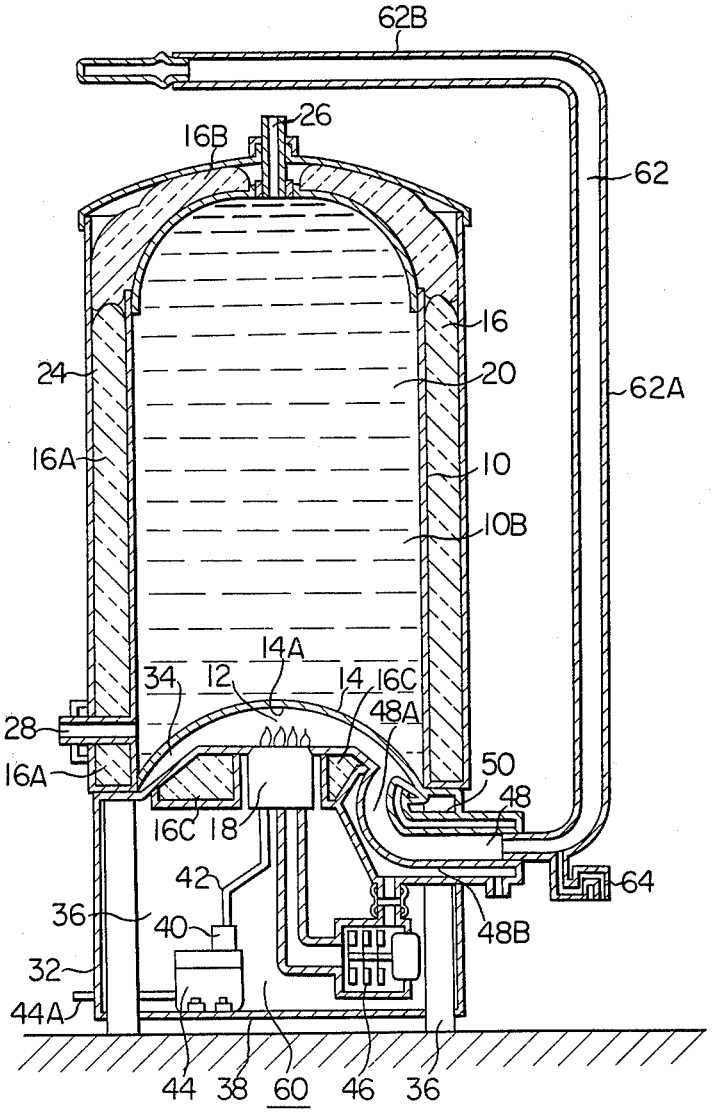
FIG. 3 is a view similar to FIG. 2 but illustrating a modification of the present invention.

FIG. 3 shows a modification of the present invention. The arrangement illustrated is different from that shown in FIG. 2 only in that in FIG. 3, a chimney 62 is connected to the exhaust tube 48 outside of the enclosure 24. The chimney 62 has a relatively small diameter and includes a vertical portion 62A which is connected to the lower end as viewed in FIG. 3 of the exhaust tube 48 and a lateral portion 62B which is connected to the upper end of the vertical portion 62A to be tilted downward at an angle of five degrees or more to the horizontal. The lateral portion 62B extends beyond the room to permit the gaseous combustion products to be exhausted to the atmosphere. Further, the vertical chimney portion 62A is provided on the lower end with a drain tube 64 for delivering drainable material formed in the chimney to the outside of the latter.

In the arrangement illustrated, the chimney 62 has a small difference between its inlet and outlet temperature with the result that a heat loss due to the convection or draft is small. In addition, as the lateral chimney portion 62B is tilted to the horizontal, drains and rain water are prevented from being introduced into the interior of the chimney 62.

From the foregoing it is seen that the present invention provides a reservoir type water heating device having a high heat efficiency. For example, the embodiment shown in each of FIGS. 2 and 3 has a quantity of dissipated heat of from 75–100 Kcal/hr during no combustion, an efficiency of heat exchange of about 85% and an operation efficiency of about 80%.

While the present invention has been illustrated and described in conjunction with a few preferred embodiments thereof it is to be understood that numerous changes and modifications may be resorted to without departing from the spirit and scope of the present invention.

What we claim is:

1. A reservoir type water heating device comprising:

a closed end drum having a hot water reservoir located therein for accumulating a specified quantity of water, said drum including a convex shaped heated surface member at the bottom which is convex toward the interior thereof through which said water is heated;

a water feed pipe connected to and communicating with said hot water reservoir for supplying cold water to said reservoir and located at the lower portion of said drum at the same vertical level to said convex shaped heated surface member for having said water strike against the lateral side of said convex shaped heated surface member for slowing the flow speed of said cold water and preventing mixing of said cold water with hot water at a higher portion in said closed end drum;

a hot water pipe for supplying hot water from said reservoir connected to and communicating with said reservoir at the top thereof for having said hot water forced upward and out through said hot water pipe by said cold water supplied at the lower portion of said drum;

fuel combustion means disposed outside of said hot water reservoir and below said reservoir, said fuel combustion means having a combustion chamber at the bottom of said drum for heating water within said reservoir through said convex shaped heated surface member and thereby having combustion products formed within said chamber; and an exhaust passageway directly connected to said combustion chamber for exhausting said combustion products from said chamber, said exhaust passageway being disposed and extending away from said chamber in spaced relationship with said reservoir so as to not come in contact with said water.

2. A reservoir type water heating device as claimed in claim 1 wherein said combustion means comprises a burner which is disposed directly under said reservoir and a blower which is disposed below said burner for supplying air for burning to said burner.

3. A reservoir type water heating device as claimed in claim 2 further comprising a pump disposed below said burner for supplying a liquid fuel to said burner.

4. A reservoir type water heating device as claimed in claim 3 further comprising an air feed passageway disposed below a peripheral portion of said combustion chamber for encircling said exhaust passageway, said air feed passageway including one end communicating with a suction side of said blower and the other end communicating with the atmosphere.

5. A reservoir type water heating device as claimed in claim 3 wherein said exhaust passageway is located between said hot water reservoir and said blower.

6. A reservoir type water heating device as claimed in claim 3 having said pump and said blower positioned so as to be spaced from said burner by a specified amount and having a portion of said insulation located on the top wall of said drum and another portion secured to the lower wall of said combustion chamber beneath the bottom of said drum.

7. A reservoir type water heating device as claimed in claim 1 wherein said exhaust passageway is a tube having a transverse tube portion which has one end portion located outside of a space disposed directly under said drum and a longitudinal tube portion having one end connected to the other end of said transverse tube portion and the other end communicating with the interior of said combustion chamber.

8. A reservoir type water heating device as claimed in claim 7 further comprising a chimney vertically disposed outside of said drum having a lower end thereof connected to said one end of said transverse tube portion.

9. A reservoir type water heating device as claimed in claim 8 wherein said chimney includes a transversely disposed extension which is tilted downward at a predetermined angle to the horizontal and connected to the upper end of said chimney.

10. A reservoir type water heating device as claimed in claim 1 further comprising a plurality of leg members disposed in spaced relationship underneath said drum for supporting said drum and thereby defining a space directly under said drum and wherein said combustion means includes a burner disposed directly under said hot water reservoir, a pump for supplying a liquid fuel to said burner and a blower for supplying burning air to said burner, said pump and blower being disposed in said spaced and a bottom plate disposed below said burner to be spaced away from the latter by a predetermined distance having said pump and blower secured thereto.

11. A reservoir type water heating device as claimed in claim 10 wherein said heated convex shaped surface member defines the upper boundary of said space in which said combustion chamber is located.

12. A reservoir type water heating device as claimed in claim 10 wherein said heated convex shaped surface member defines the upper boundary of said space in which a substantial part of said burner is located.

13. A reservoir type water heating device as claimed in claim 1 wherein said combustion means includes a burner disposed directly under said drum along the longitudinal axis thereof and said heated convex surface member has its center disposed at the highest level along said longitudinal axis.

14. A reservoir type water heating device as claimed in claim 1 wherein said combustion chamber has a surface member opposite said convex shaped member and said exhaust passageway opens into a peripheral portion of said combustion chamber on said surface member thereof.

15. A reservoir type water heating device as claimed in claim 1 wherein said water supply pipe is connected to a lateral peripheral wall of said drum and said hot water delivery pipe is connected to the central portion of a top wall of said drum.

16. A reservoir type water heating device as claimed in claim 1 further comprising an outer enclosure disposed so as to encircle said drum for having an annular space of predetermined width therebetween, and a heat insulating material filling said space.

* * * * *